US009133660B2

(12) United States Patent
Wen

(10) Patent No.: US 9,133,660 B2
(45) Date of Patent: Sep. 15, 2015

(54) DEVICE FOR ADJUSTING SLATS OF WINDOW BLIND

(71) Applicant: NIEN MADE ENTERPRISE CO., LTD., Taichung (TW)

(72) Inventor: Yu-Che Wen, Taoyuan County (TW)

(73) Assignee: NIEN MADE ENTERPRISE CO., LTD., Taichung (TW)

( * ) Notice: Subject to any disclaimer, the term of this patent is extended or adjusted under 35 U.S.C. 154(b) by 139 days.

(21) Appl. No.: 13/777,687

(22) Filed: Feb. 26, 2013

(65) Prior Publication Data

US 2014/0174676 A1 Jun. 26, 2014

(51) Int. Cl.

| | |
|---|---|
| ***E06B 9/32*** | (2006.01) |
| ***E06B 9/322*** | (2006.01) |
| ***E06B 9/36*** | (2006.01) |

(52) U.S. Cl.

CPC ..... *E06B 9/322* (2013.01); *E06B 9/364* (2013.01); *E06B 9/368* (2013.01)

(58) Field of Classification Search

CPC ..... E06B 9/364; E06B 9/362; E06B 9/367; E06B 9/36; E06B 7/084

USPC ..... 160/177 R, 177 V, 176.1 V, 168.1 V, 160/178.1 V, 174 V, 172, 173 V, 900, 167 V; 16/87.4, 94 DR

See application file for complete search history.

(56) References Cited

U.S. PATENT DOCUMENTS

| | | | | | |
|---|---|---|---|---|---|
| 1,677,815 | A | * | 7/1928 | Croft | 407/18 |
| 3,688,365 | A | * | 9/1972 | Gubelmann | 407/20 |
| 3,878,877 | A | * | 4/1975 | Bruneau et al. | 160/168.1 R |
| 4,214,622 | A | * | 7/1980 | Debs | 160/168.1 R |
| 4,262,728 | A | * | 4/1981 | Debs | 160/168.1 R |
| 4,834,163 | A | * | 5/1989 | Dickstein | 160/176.1 R |
| 5,056,578 | A | * | 10/1991 | Helver | 160/177 R |
| 5,095,966 | A | * | 3/1992 | Rogers | 160/168.1 R |
| 5,291,946 | A | * | 3/1994 | Ciriaci | 160/177 R |
| 5,413,162 | A | * | 5/1995 | Ciriaci | 160/177 V |
| 5,577,542 | A | * | 11/1996 | Hung | 160/177 V |

(Continued)

FOREIGN PATENT DOCUMENTS

| | | | |
|---|---|---|---|
| JP | H04140545 | | 5/1992 |
| JP | 2004225823 | | 8/2004 |
| JP | 2004225823 | A * | 8/2004 |
| JP | 2010111301 | A * | 5/2010 |

OTHER PUBLICATIONS

Karone, Kenneth "Gear Design: breaking the status quo" Machine Design. May 10, 2007. <http://machinedesign.com/archive/gear-design-breaking-status-quo> Accessed: Sep. 10, 2014.*

*Primary Examiner* — Katherine Mitchell
*Assistant Examiner* — Johnnie A Shablack
(74) *Attorney, Agent, or Firm* — Ming Chow; Sinorica, LLC

(57) ABSTRACT

A device for adjusting a slat of a window blind including a housing, in which a plurality of frames, a rod, a plurality of transmission members, and a plurality of turning members are provided. The rod is meshed with a first rack of each transmission member, and the turning members are respectively meshed with a second rack of each transmission member. The first rack has a plurality of teeth in a line, and the first and the last teeth are shorter than the rest teeth. Furthermore, the first and the last teeth are designed for ratchet, so that the teeth of the rod will slide on and over the first or the last teeth when the user is overturning the rod to protect the teeth of the first rack of the transmission member.

7 Claims, 8 Drawing Sheets

(56) References Cited

U.S. PATENT DOCUMENTS

| | | | | | |
|---|---|---|---|---|---|
| 5,626,177 | A * | 5/1997 | Colson et al. | 160/168.1 V |
| 5,699,846 | A * | 12/1997 | Ohanesian | 160/118 |
| 5,845,695 | A * | 12/1998 | Cadorette et al. | 160/173 V |
| 5,894,877 | A * | 4/1999 | Sommerfeld | 160/168.1 V |
| 6,076,588 | A * | 6/2000 | Swiszcz et al. | 160/168.1 V |
| 6,105,656 | A * | 8/2000 | Hernandez et al. | 160/174 V |
| 6,240,998 | B1 * | 6/2001 | Miwa | 160/168.1 V |
| 7,556,081 | B2 * | 7/2009 | Cech | 160/176.1 V |
| 7,997,323 | B2 * | 8/2011 | Cech | 160/176.1 V |
| 8,475,315 | B2 * | 7/2013 | Kobayashi et al. | 475/180 |
| 8,770,054 | B2 * | 7/2014 | Yamakawa | 74/422 |
| 8,776,860 | B2 * | 7/2014 | Wen et al. | 160/178.1 V |
| 2003/0201077 | A1 * | 10/2003 | Mullet et al. | 160/192 |
| 2009/0071612 | A1 * | 3/2009 | Hung | 160/174 V |

* cited by examiner

DEVICE FOR ADJUSTING SLATS OF WINDOW BLIND

BACKGROUND OF THE INVENTION

1. Field of the Invention

The present invention relates generally to a window covering, and more particularly to a device for adjusting slats of a window blind.

2. Description of the Related Art

FIG. 1 shows a conventional device for adjusting slats of a vertical window blind. The device includes a rod 200, a turning member 210 connected to the slats, and a transmission member 220 connecting the rod 200 and the turning member 210. The rod 200 is turned by a user to turn the turning member 210 through the transmission member 220, and that may tilt the slats.

In the conventional device, the rod 200, the turning member 210 and the transmission member 220 respectively have teeth meshed with each other, and the teeth have the same height. It is always found that the first and the last teeth on the transmission member 220 are easy to be broken. Usually, it is caused by overturning the rod 200. Therefore, the old design has to be improved.

SUMMARY OF THE INVENTION

The primary objective of the present invention is to provide a device for adjusting slats of a window blind, which may avoid the teeth of the transmission member being damaged.

According to the objective of the present invention, a device for adjusting a slat of a window blind includes a rod, a transmission member, and a turning member. The rod has teeth, and the transmission member has a first rack and a second rack. The teeth of the rod are meshed with the first rack of the transmission member to move the transmission member between the first position and a second position. The turning member has a gear to be meshed with the second rack of the transmission member, so that the turning member is turned while the transmission member is reciprocating between the first position and the second position. The first rack has a plurality of teeth in a line; the teeth of the first rack are projected from a root surface; each of the teeth has a tip at a distal end thereof and a root connected to the root surface; each of the teeth has a height, which is a distance between the tip and the root surface; and the heights of the first tooth of the line and the last tooth of the line are shorter than the rest teeth.

In an embodiment, the teeth of the rod have an addendum circle and a pitch circle; and the tip of the first tooth is between the addendum circle and the pitch circle when the transmission member reaches the first position, and the tip of the last tooth is between the addendum circle and the pitch circle when the transmission member reaches the second position.

In an embodiment, a first included angle is between a first tooth surface and the root surface, and a second included angle is between a second tooth surface and the root surface; and the second included angle is greater than the first included angle.

In an embodiment, a first reference point is a point at a center of the root; a second reference point is a projection of the tip on the root; and the second reference point is closer to the neighboring tooth than the first reference point.

In an embodiment, a length of the first tooth surface is greater than a length of the second tooth surface.

In an embodiment, the teeth next to the first tooth and the last tooth respectively have a third tooth surface and a fourth tooth surface at opposite side of the tip; the third tooth surface is closer to the first tooth or the last tooth than the fourth tooth surface; and a length of the third tooth surface is greater than a length of the fourth tooth surface.

In an embodiment, the third tooth surface has a curved profile.

In an embodiment, the third tooth surface has an elliptical arc in a vertical cross section of the tooth.

In an embodiment, the device further includes a main member having a housing and a frame received in the housing, wherein the frame has a bore and a chamber; the rod is received in the housing and passes through the bore of the frame; the turning member is pivoted on the frame; and the transmission member is received in the chamber of the frame for reciprocation.

Therefore, the device of the present invention may prevent the teeth of the first rack of the transmission member from being damaged by overturning the rod.

DETAILED DESCRIPTION OF THE INVENTION

Figure 1:
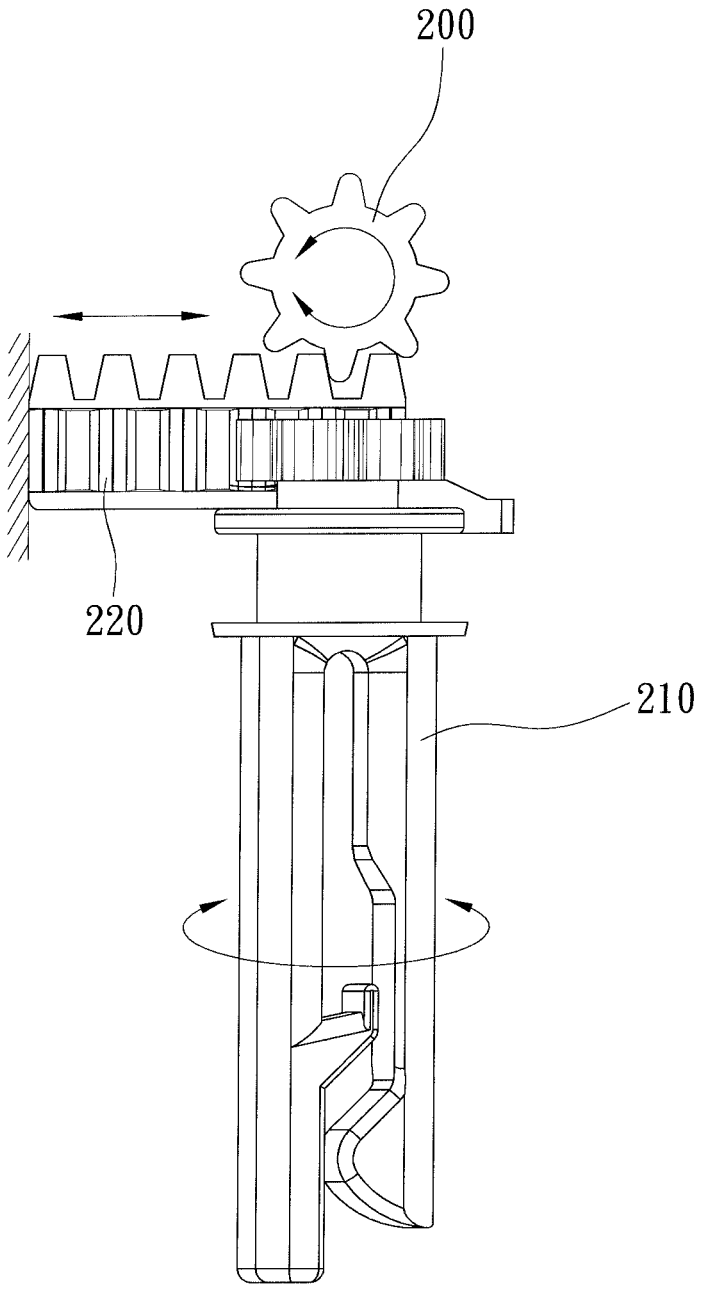
FIG. 1 (PRIOR ART)
FIG. 1 is perspective views of the conventional device for adjusting the slats of the window blind.
Figure 2:
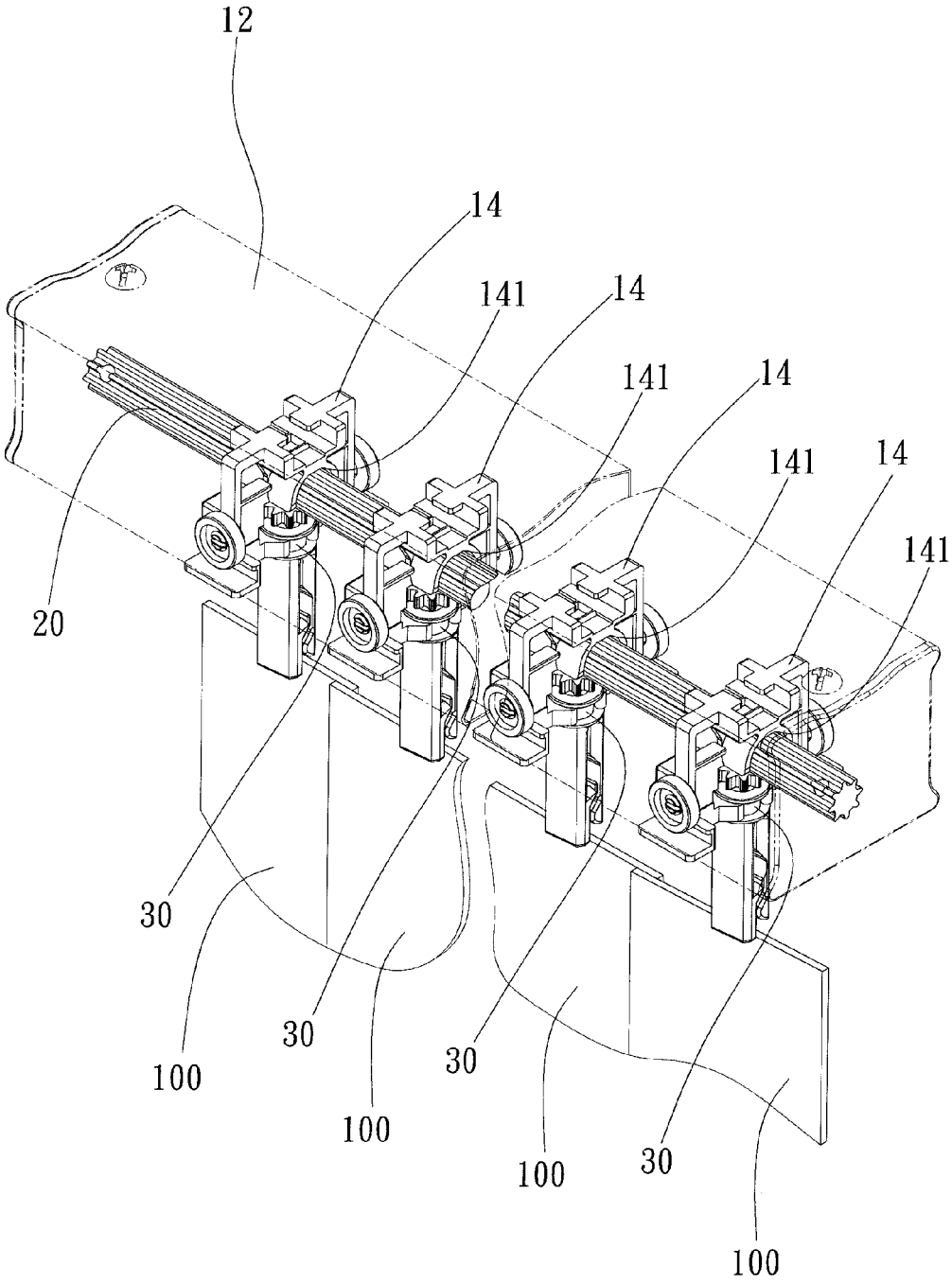
FIG. 2 is a perspective view of a preferred embodiment of the present invention.
Figure 3:
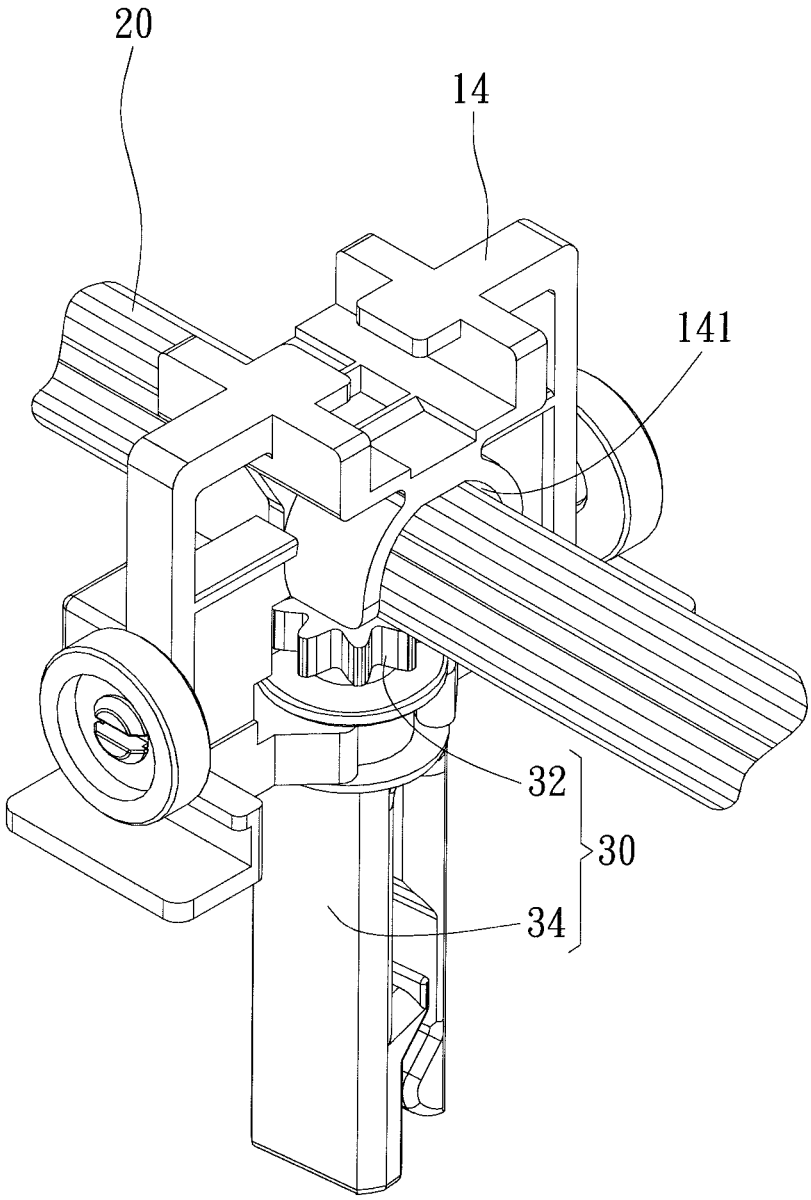
FIG. 3 is a perspective view of the preferred embodiment of the present invention.
Figure 4:
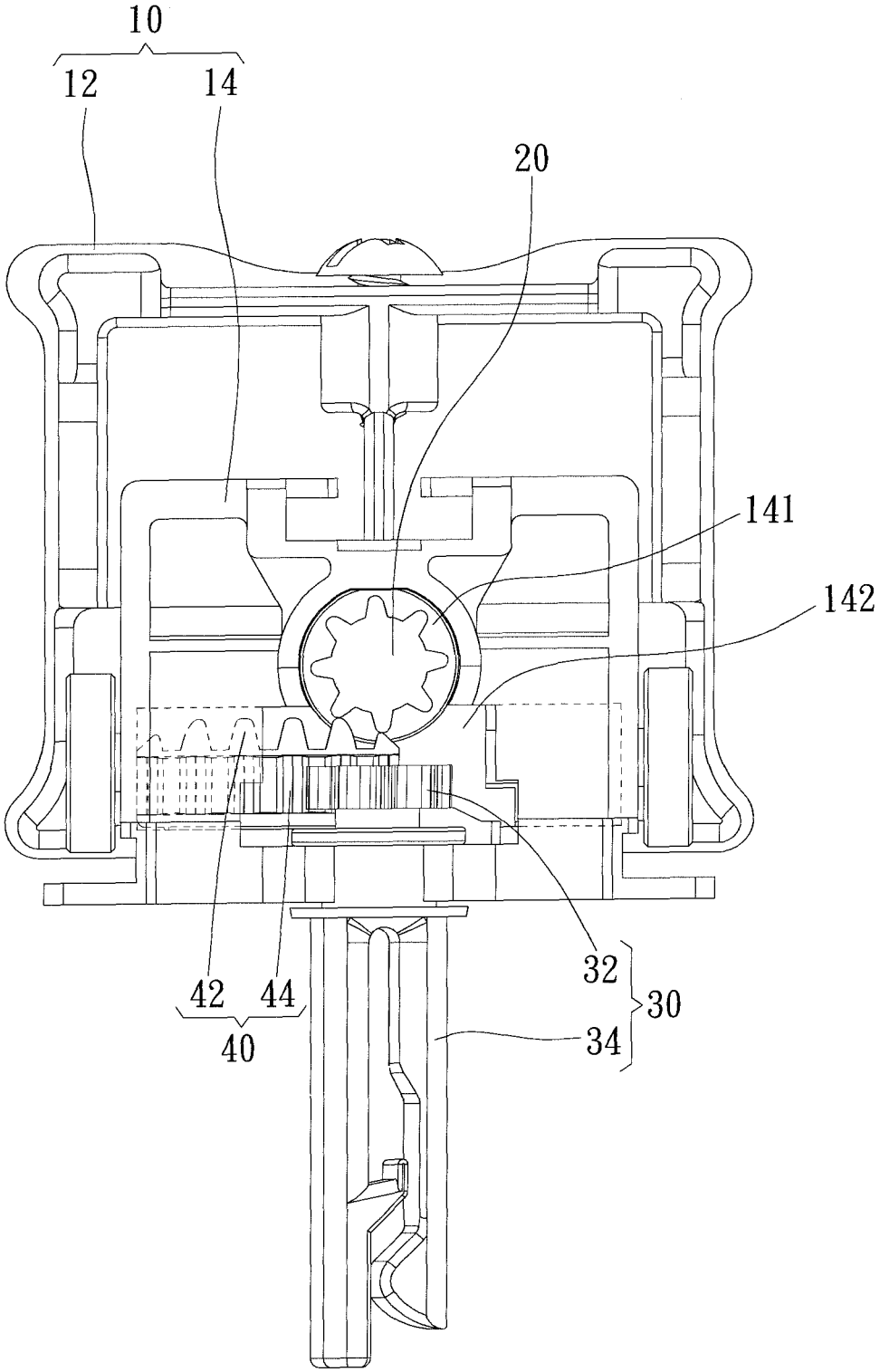
FIG. 4 is a sketch diagram of the preferred embodiment of the present invention, showing the transmission member in the first position.

FIGS. from FIG. 2 to FIG. 4 show a device for adjusting slats 100 of a window blind of the preferred embodiment of the present invention. The device includes a main member 10, a rod 20, a plurality of turning members 30, and a plurality of transmission members 40.

The main member 10 has a housing 12 and a plurality of frames 14. The frames 14 are received in the housing 12. Each frame 14 has a transverse bore 141 and a chamber 142. The transverse bore 141 is above the chamber 142 and is communicated with the chamber 142.

As shown in FIG. 3 and FIG. 4, the rod 20 has teeth on a surface thereof. The rod 20 is received in the housing 12 and serially passes through the transverse bores 141 of the frames 14. The rod 20 is turned by a gear or a chain.

The turning members 30 have ends respectively pivoted on bottom sides of the frames 14 for free rotation related to the frames 14. Each turning member 30 has a gear 32 at the end pivoted on the frame 14, and the gear 32 is received in the chamber 142 of the frame 14. Each turning member 30 is provided with a connector 34, which is outside the frame 14, to connect the slat 100. The connector 34 of the turning member 30 is a conventional device, so we do not describe the detail here.

Figure 5:
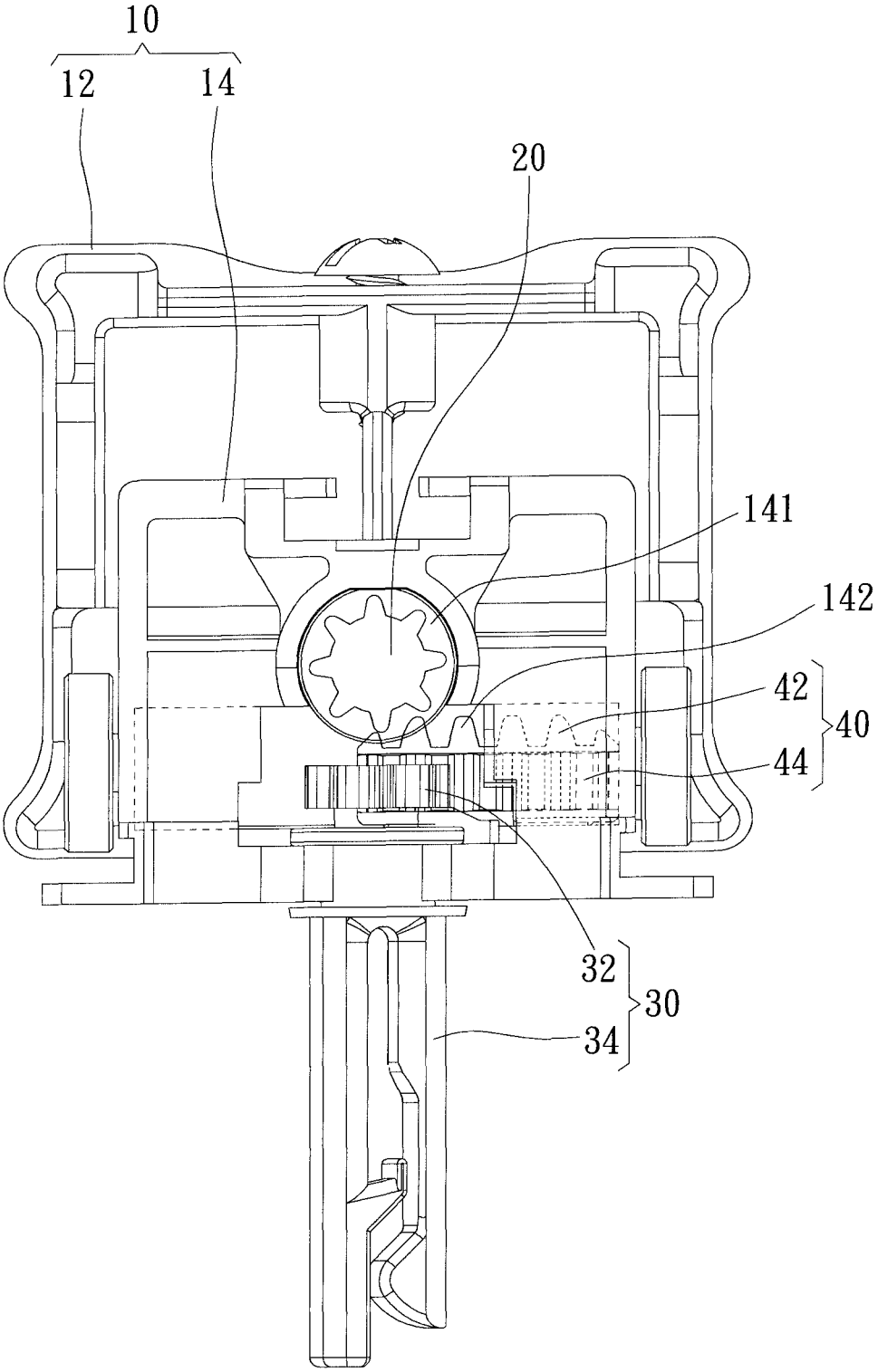
FIG. 5 is a sketch diagram of the preferred embodiment of the present invention, showing the transmission member in the second position.
Figure 6:
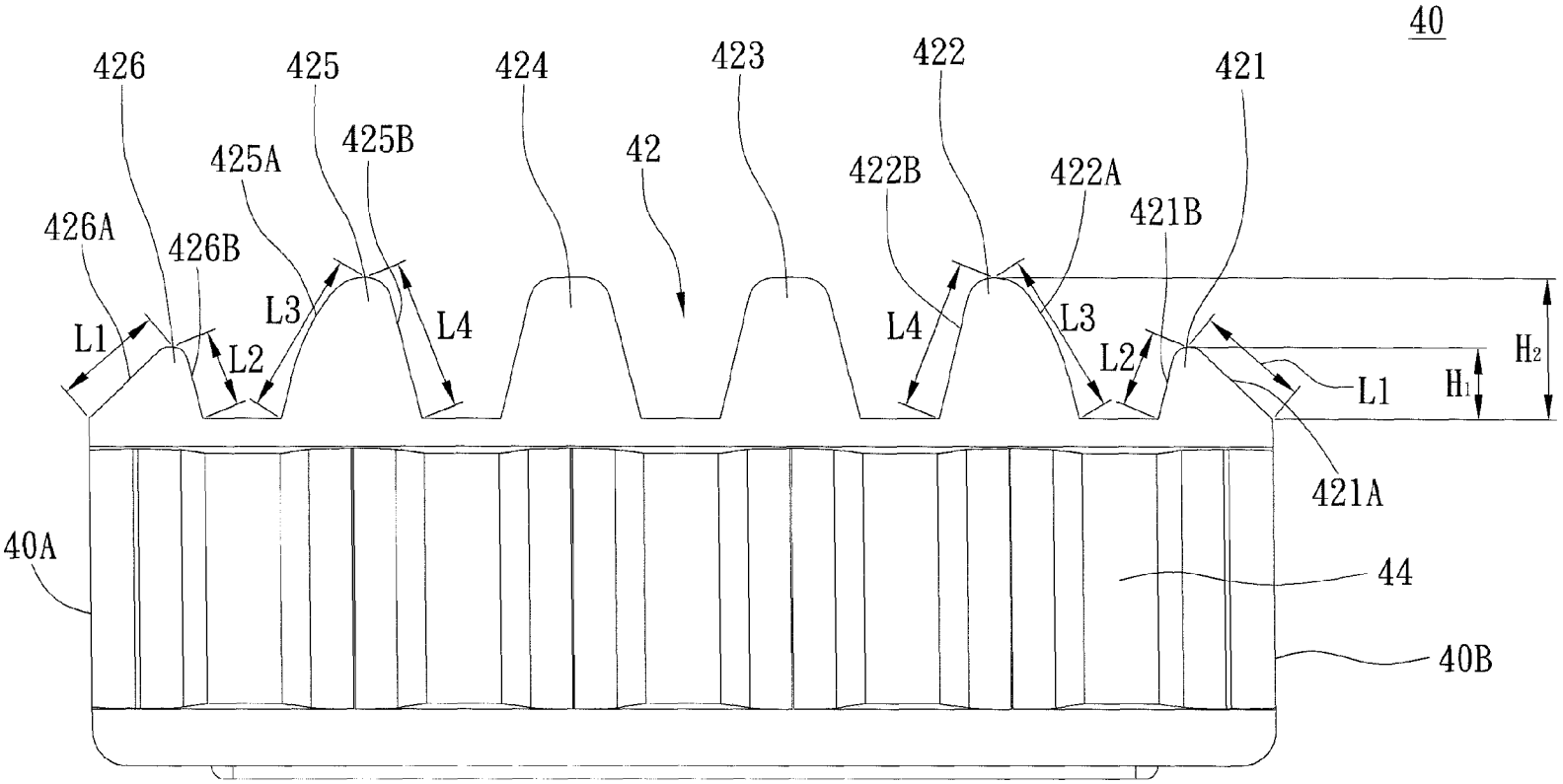
FIG. 6 is a front view of the transmission member of the preferred embodiment of the present invention.
Figure 7:
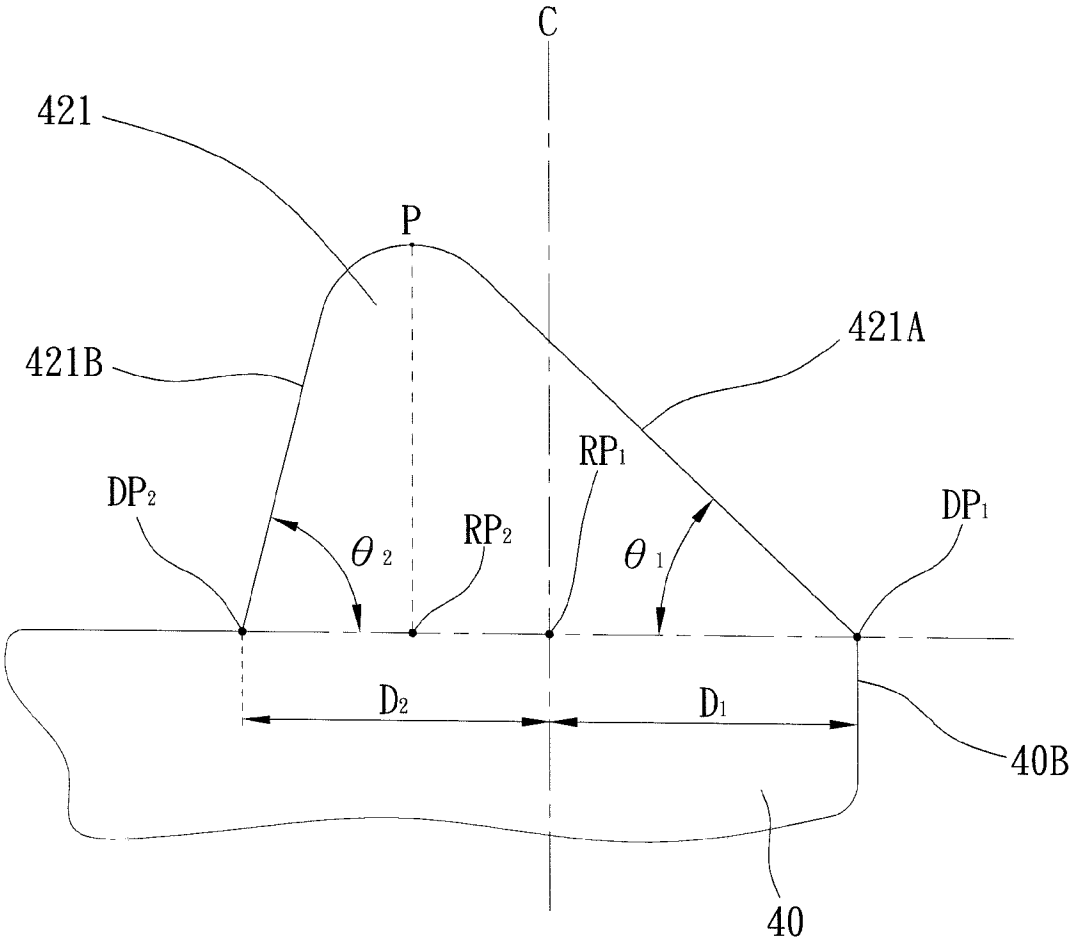
FIG. 7 is a sketch diagram of the first tooth of the transmission member of the preferred embodiment of the present invention.

The transmission members 40 are respectively received in the chambers 142 of the frames 14 to be moved between a first position (FIG. 4) and a second position (FIG. 5) by the rod 20. As shown in FIG. 6, each transmission member 40 is a rectangular block and has a first rack 42 on a top side thereof and a second rack 44 on a front side. The first rack 42 has parallel teeth 421-426 projected from a root surface, which is the top side of the transmission member 40 in the present embodiment. The teeth 421-426 are arranged in a line and extends from a right side 40B to a left side 40A of the transmission member 40. Each tooth 421-426 has a root connected to the root surface and a tip P, which is a highest point of the tooth. Each tooth has a height, which is a vertical distance between the root surface and the tip P. The tips P of the first tooth 421 (closest to the right side 40B) and the last tooth 426 (closest to the left side 40A) are lower than the rest teeth 422-425. In an embodiment, the heights $H_1$ of the first tooth 421 and the last tooth 426 are about ⅓ to ⅔ of the heights $H_2$ of the rest teeth 422-425. Take the first tooth 421 for example, referring to FIG. 7, it has a vertical central line C, which is vertical to the root surface and passes through a center of a root of the tooth 421. On opposite sides of the tip P has a first tooth surface 421A and a second tooth surface 421B, wherein the first tooth surface 421A is proximal to the right side 40B, and the second tooth surface 421B is proximal to the second tooth 422. A first standard point $DP_1$ is a junction of the first tooth surface 421A and the root surface, and a second standard point $DP_2$ is a junction of the second tooth surface 421B and the root surface. A first reference point RP1 is an intersection of the vertical central line C and the root surface, and a second reference point $RP_2$ is a projection of the tip P on the root surface. $D_1$ is a distance between the first reference point $RP_1$ and the first standard point $DP_1$, and $D_2$ is a distance between the first reference point $RP_1$ and the second standard point $DP_2$. In an embodiment, $D_1$ is equal to $D_2$. The first reference point $RP_1$ of the tooth 421 is closer to the right side 40B than the second reference point $RP_2$. The tooth 421 further complies with the following conditions:

1) L1>L2; and

2) $\theta_1<\theta_2$;

where

L1 is a length of the first tooth surface 421A;

L2 is a length of the second tooth surface 421B;

$\theta_1$ is an included angle between the first tooth surface 421A and the root surface; and $\theta_2$ is an included angle between the second tooth surface 421B and the root surface.

The last tooth 426 of the first rack 42 is symmetrical to the first tooth 421, so we do not describe it again.

The second tooth 422, which is next to the first tooth 421, of the first rack 42 has a third tooth surface 422A and a fourth tooth surface 422B. The third tooth surface 422A is closer to the first tooth 421 than the fourth tooth surface 422B. The third tooth surface 422A has a curved profile. In an embodiment, the third tooth surface 422A has an elliptical arc in a vertical cross section of the second tooth 422. The second tooth 422 further complies with the following condition:

3) L3>L4;

where

L3 is a length of the third tooth surface 422A; and

L4 is a length of the fourth tooth surface 422B.

The tooth 425 beside the last tooth 426 is symmetrical to the second tooth 422, so we do not describe it again.

As a result, while the user is turning the rod 20, it may move the transmission member 40 to rotate the turning member 30 so as to tilt the slats 100.

Figure 8:
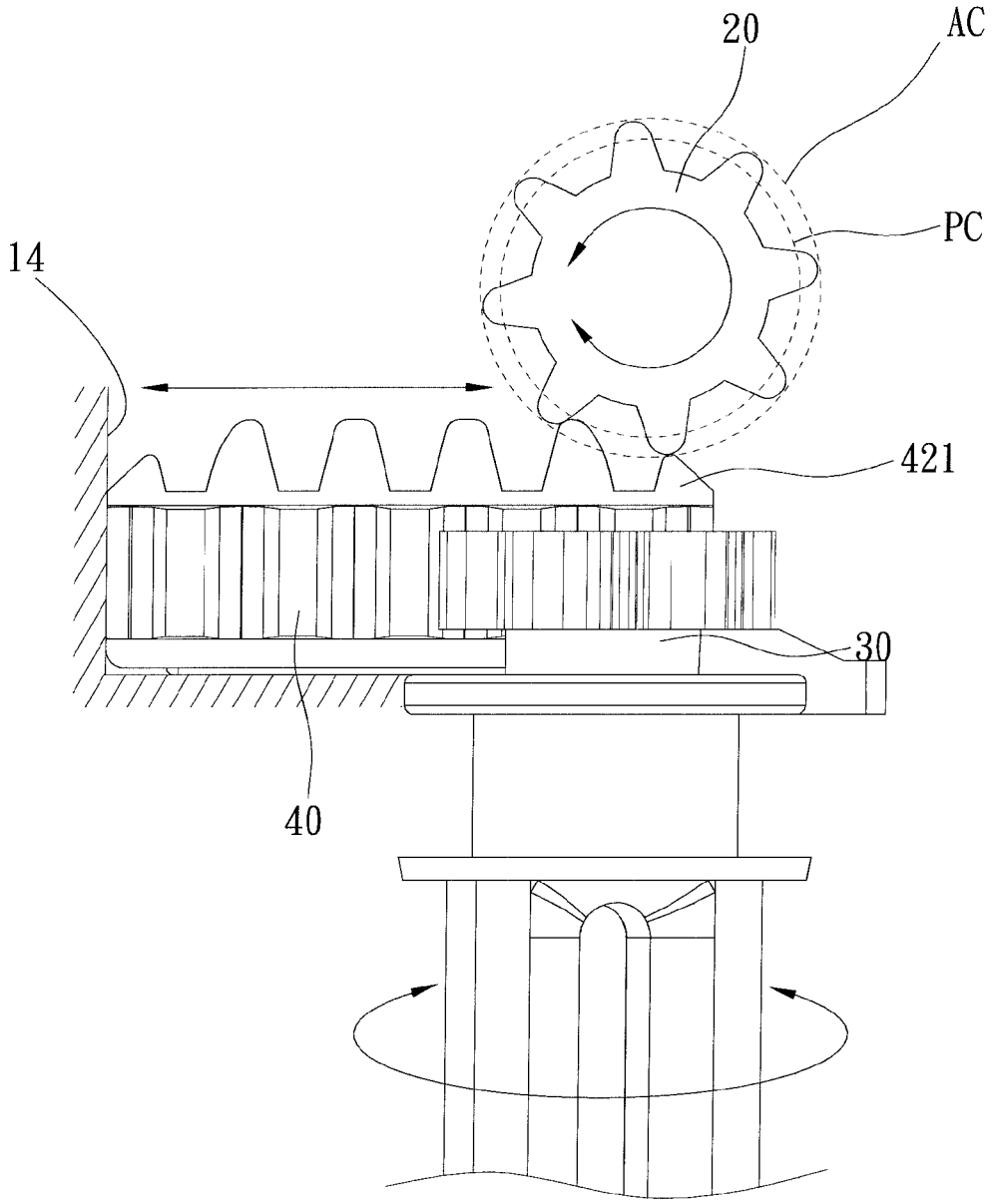
FIG. 8 is a sketch diagram of the preferred embodiment of the present invention, showing the actions of the related elements.

As shown in FIG. 8, the teeth of the rod 20 has an addendum circle AC and a pitch circle PC. (The addendum circle coincides with the tops of the teeth of a gear and is concentric with the standard (reference) pitch circle and radially distant from it by the amount of the addendum, and the pitch circle is the curve of intersection of a pitch surface of revolution and a plane of rotation.) While the transmission member 40 is moved to the first position or the second position, the tip P of the tooth 421 or 426 is between the addendum circle AC and the pitch circle PC. While the transmission member 40 reaches the first position or the second position and the user is still turning the rod 20, the teeth of the rod 20 will slide on the first tooth surface 421A (or 426A) of the tooth 421 (or 426) and the third tooth surface 422A (or 425A) of the tooth 422 (or 425), and slide over the teeth 421, 422 (or 426, 425) to prevent the teeth 421, 422 (or 426, 425) from being damaged by overturning the rod 20. While the teeth of the rod 20 slip, they will also provide a "click" feedback to the user to inform him/her that it's time to stop turning.

A slopes of the second tooth surface 421B (426B) is steeper than that of the first tooth surface 421A (426A) of the first (last) tooth 421 (426) that may make the teeth of the rod 20 to be re-meshed with the tooth 421 (426) while the user turns the rod 20 reversely.

The description above is only a few preferred embodiments of the present invention and the equivalence of the present invention is still in the scope of claim construction of the present invention.

What is claimed is:

1. A device for adjusting a slat of a window blind, comprising:

a rod having teeth;

a transmission member having a first rack and a second rack, wherein the teeth of the rod are meshed with the first rack of the transmission member to move the transmission member between a first position and a second position;

a turning member having a gear to be meshed with the second rack of the transmission member, so that the turning member is turned while the transmission member is reciprocating between the first position and the second position;

the first rack has a plurality of teeth in a line; the teeth of the first rack are projected from a root surface; each of the teeth has a tip at a distal end thereof and a root connected to the root surface; each of the teeth has a height, which is a distance between the tip and the root surface; and the heights of the first tooth of the line and the last tooth of the line are shorter than the rest of the teeth;

the first tooth and the last tooth of the first rack respectively have a first tooth surface and a second tooth surface at an opposite side of the tip;

the second tooth surface is closer to a neighboring tooth than the first tooth surface is to the neighboring tooth;

the neighboring tooth of the first tooth and the neighboring tooth of the last tooth respectively have a third tooth surface and a fourth tooth surface at an opposite side of the tip;

the third tooth surface is closer to the first tooth or the last tooth than the fourth tooth surface is to the first tooth or the last tooth;

a length of the third tooth surface is greater than a length of the fourth tooth surface;

the third tooth surface has a curved profile;

the teeth of the rod is allowed to slide on the first tooth surface and the third tooth surface due to coordination between the curved profile of the third tooth surface and the height of the first tooth or the last tooth; and when the teeth of the rod slide on the first tooth surface and the third tooth surface, a click feedback is produced.

2. The device as defined in claim 1, wherein the teeth of the rod have an addendum circle and a pitch circle; and the tip of the first tooth is between the addendum circle and the pitch circle when the transmission member reaches the first position, and the tip of the last tooth is between the addendum circle and the pitch circle when the transmission member reaches the second position.

3. The device as defined in claim 1, wherein a first included angle is between the first tooth surface and the root surface, and a second included angle is between the second tooth surface and the root surface; and the second included angle is greater than the first included angle.

4. The device as defined in claim 1, wherein a first reference point is a point at a center of the root; a second reference point is a projection of the tip on the root; and the second reference point is closer to the neighboring tooth than the first reference point.

5. The device as defined in claim 1, wherein a length of the first tooth surface is greater than a length of the second tooth surface.

6. The device as defined in claim 1, wherein the third tooth surface has an elliptical arc in a vertical cross section of the tooth.

7. The device as defined in claim 1, further comprising a main member having a housing and at least one frame received in the housing, wherein the frame has a bore and a chamber; the rod is received in the housing and passes through the bore of the frame; the turning member is pivoted on the frame; and the transmission member is received in the chamber of the frame for reciprocation.

* * * * *